US007723013B2

(12) United States Patent
Goodin

(10) Patent No.: US 7,723,013 B2
(45) Date of Patent: May 25, 2010

(54) NEGATIVE-ACTING PHOTOLITHOGRAPHIC PRINTING PLATE WITH IMPROVED PRE-BURN PERFORMANCE

(75) Inventor: Jonathan Goodin, Wake Forest, NC (US)

(73) Assignee: Southern Lithoplate, Inc., Youngsville, NC (US)

( * ) Notice: Subject to any disclaimer, the term of this patent is extended or adjusted under 35 U.S.C. 154(b) by 0 days.

(21) Appl. No.: 12/008,308

(22) Filed: Jan. 9, 2008

(65) Prior Publication Data

US 2008/0171288 A1 Jul. 17, 2008

Related U.S. Application Data

(60) Provisional application No. 60/879,836, filed on Jan. 11, 2007.

(51) Int. Cl.
*G03C 1/00* (2006.01)

(52) U.S. Cl. ..... 430/302; 430/270.1; 430/281.1; 430/282.1

(58) Field of Classification Search ..... 430/270.1, 430/302
See application file for complete search history.

(56) References Cited

U.S. PATENT DOCUMENTS

| | | | | |
|---|---|---|---|---|
| 4,374,193 | A | 2/1983 | Moriya et al. | 430/149 |
| 4,665,124 | A | 5/1987 | Walls et al. | 525/61 |
| 4,708,925 | A | 11/1987 | Newman | 430/270.1 |
| 4,940,646 | A | 7/1990 | Pawlowski | 430/175 |
| 5,169,897 | A | 12/1992 | Walls | 525/61 |
| 5,169,898 | A | 12/1992 | Walls et al. | 525/61 |
| 5,340,699 | A | 8/1994 | Haley et al. | 430/302 |
| 5,372,907 | A | 12/1994 | Haley et al. | 430/157 |
| 5,372,915 | A | 12/1994 | Haley et al. | 430/302 |
| 5,663,037 | A | 9/1997 | Haley et al. | 430/278.1 |
| 5,700,619 | A | 12/1997 | Baumann et al. | 430/175 |
| 5,705,322 | A | 1/1998 | West et al. | 430/325 |
| 5,763,134 | A | 6/1998 | Busman et al. | 430/157 |
| 5,792,823 | A | 8/1998 | Kim et al. | 526/266 |
| 6,255,033 | B1 | 7/2001 | Levanon et al. | 430/275.1 |
| 6,387,595 | B1 * | 5/2002 | Teng | 430/302 |
| 6,541,181 | B1 | 4/2003 | Levanon et al. | 430/275.1 |
| 6,605,416 | B2 | 8/2003 | Busman et al. | 430/325 |
| RE38,251 | E | 9/2003 | Busman et al. | 430/157 |
| 6,737,220 | B2 * | 5/2004 | Mori | 430/302 |
| 6,808,858 | B2 | 10/2004 | Fuss et al. | 430/157 |
| 2005/0277756 | A1 * | 12/2005 | Iwabuchi et al. | 528/38 |
| 2007/0269739 | A1 * | 11/2007 | Nguyen et al. | 430/270.1 |

FOREIGN PATENT DOCUMENTS

| | | |
|---|---|---|
| JP | 09328519 | 12/1997 |

* cited by examiner

*Primary Examiner*—Cynthia H Kelly
*Assistant Examiner*—Chanceity N Robinson
(74) *Attorney, Agent, or Firm*—Mark A. Litman & Associates, P.A.

(57) ABSTRACT

A negative-acting photolithographic printing plate precursor has a unique negative-acting photosensitive composition on a surface. The photosensitive composition contains an acetal polymer, an infrared absorbing dye or pigment, a crosslinking agent for the acetal resin and a photosensitive chemical acid progenitor, and the acetal polymer has within its backbone a structure comprising a particular polymeric moiety derived from a polyvinyl alcohol backbone.

16 Claims, No Drawings

NEGATIVE-ACTING PHOTOLITHOGRAPHIC PRINTING PLATE WITH IMPROVED PRE-BURN PERFORMANCE

RELATED APPLICATIONS DATA

This application claims priority from U.S. Provisional Patent Application No. 60/879,836, filed Jan. 11, 2007 and titled "NEGATIVE-ACTING PHOTOLITHOGRAPHIC PRINTING PLATE WITH IMPROVED PRE-BURN PERFORMANCE."

BACKGROUND OF THE INVENTION

1. Field of the Invention

The present invention relates to the field of reproducing images in large numbers, particularly image production by printing technology, and more particularly to the field of negative-acting photolithographic printing plates and methods of their use.

2. Background of the Art

The art of lithographic printing is based on the immiscibility of oil and water and the relative oleophilic and oleophobic properties of materials that undergo chemical changes, particularly polymerization and depolymerization. In one lithographic printing format, the oily material or ink is preferentially retained by the image area and the water or fountain solution is preferentially retained by the non-image area. When a suitably prepared surface is moistened with water and an ink is then applied, the background or non-image area retains the water while the image area accepts ink and repels the water. The ink on the image area is then transferred to the surface of a material upon which the image is to be reproduced, such as paper, cloth and the like. In the transfer printing process, commonly the ink is transferred to an intermediate material called the blanket which in turn transfers the ink to the surface of the material upon which the image is reproduced.

A generally used type of lithographic printing form precursor has a light sensitive coating applied to a substrate. In most commercial environments an aluminum base support is used. In flexographic printing, a polymeric substrate, such as polyester film is used. Negative working lithographic printing form precursors have a radiation sensitive coating which, when image-wise exposed to light, hardens in the exposed areas. On development the non-exposed areas of the coated composition are removed leaving the image. Positive working lithographic printing form precursors have a radiation sensitive coating which, when image-wise exposed to light, decomposes and/or loses oleophilic properties in the exposed areas. On development the exposed areas of the coated composition are removed leaving the image.

Polyvinyl acetals polymers, especially polyvinyl butyrals are used in a very wide range of products as binders and oleophilic enhancers, primarily due to their excellent film forming, outstanding mechanical characteristics and their ability to contribute to the oleophilic properties of the imaged lithographic layer. These polymers are also known as materials with very good resistance to chemical attack. The polyvinyl butyrals or polyvinyl formals belong to the classes of materials that are not soluble in aqueous developers used in the preparation of printing plates or printing circuit boards. Many different polymers have been proposed for use as binders in conventional analogue negative-working UV-sensitive compositions that provide the required aqueous solubility. Particular advantages have been achieved for polymers containing hydroxyl groups or carboxyl groups in the acetal moieties. These binder polymers are described, by way of non-limiting examples, in U.S. Pat. Nos. 4,665,124; 4,940,646; 5,169,898; 5,169,897; 5,700,619 and 6,808,858. A photosensitive material containing a resin binder, including a vinylic or ethylenic polymer having phenolic hydroxyl groups and aromatic diazonium salt having only a single diazo group was disclosed in U.S. Pat. No. 4,374,193. and (cf. for example H. Baumann and H.-J. Timpe: "Chemical Aspects of Offset Printing" in J. prakt. Chem. Chemiker-Zeitung 336 (1994), pages 377-389). In all the above cases, the acetal containing resins are used in combination with diazonium salt compositions and only in conventional analog imaging and printing applications, as opposed to digital applications.

More recent developments in the field of lithographic printing form precursors have provided radiation-sensitive compositions useful for the preparation of direct laser addressable printing form precursors. Digital imaging information can be used to image the printing form precursor without the need to utilize an imaging master such as a photographic transparency, template or mask.

Today, many imaging processes use infra-red or near infra-red radiation from semiconductor diode lasers to image printing plates. Semiconductor diode lasers have the advantage of being much less expensive than ultraviolet lasers of the same power. They are also well adapted for the production of high resolution images and for digital imaging processes (i.e., for producing hard copies of images stored on computers in digital form). The cost per exposure unit intensity is less for an infrared producing high-resolution addressable source than for a comparable ultraviolet radiation producing source. The above fore-mentioned patents utilizing diazonium salt compositions do not have good natural sensitivity to near infra-red or infra-red laser irradiation.

U.S. Pat. No. 4,708,925 describes a negative working plate system with additional process steps performed after imaging and pre-development. In this disclosed process, the decomposition by-products are subsequently used to catalyze a cross-linking reaction between resins that insolubilize in the imaged areas prior to provide the development step in the formation of the printing plate. However, the process of this patent requires two exposure steps to be utilized as a negative-working plate, i.e., an image-wise exposure and a subsequent overall exposure.

U.S. Pat. No. 5,705,322 has a similar two step exposure process with a diazonaphthoquinone containing composition, except in this case the image-wise exposure is carried out with a near infra-red laser. The additional process step requirements add greatly to the cost and complexity of the process. The resins described in both patents are novolaks of phenol and formaldehyde.

U.S. Pat. Nos. 5,340,699; 5,372,907; 5,372,915; and 5,663,037 describe near infra-red laser imageable negative working systems that utilize a latent Bronsted acid or triazine with an infrared light absorbing dye. The resin system that is used is a combination of novolak and resol resins. U.S. Pat. Nos. 5,763,134, 6,605,416 and RE38,251 describe a negative working infra-red laser imageable composition in which specific squarylium dyes are used. The binder system that is described is again a novolak polymer.

The above described printing form precursors of the prior art which can be employed as direct imaged negative working printing form precursors are lacking in one or more desirable features. Moreover, these printing form precursor systems have constraints on their components which create difficulties in optimizing plate properties to provide optimum performance across the wide range of demanding lithographic plate performance parameters, including pre-heat temperature, developer solubility, solvent resistance, runlength and adhesion.

U.S. Pat. No. 6,541,181 describes acetal binder materials for use in a positive working system utilizing thermal lasers. In this format of process, the exposed areas are washed away during the development process rather than become the ink-retaining image to be printed onto the blanket or ink-receiving surface.

Photosensitive lithographic printing plates and those used for (Computer to Plate) CtP imaging is used in extremely demanding circumstances. Therefore, the coating compositions that are used for creating the image must meet exacting performance standards.

The properties of the photosensitive composition can be improved by several commercial and literature-disclosed methods. One method is to find new ingredients such as initiators, colorants, crosslinking agents, additives, etc. Another method is to optimize the amounts of each ingredient. Still another method is to optimize the conditions and equipment used to expose and develop the lithographic printing plates. The approach used in this disclosure to improve the plate coating composition characteristics and hence the plate performance is to provide novel polymer systems that enhance the physical properties and the reaction performance properties of the coating. This approach is likely to afford greater benefits than the other approaches because the polymer system represents the largest single element of any plate coating and the composition performance tends to be the limiting parameter with respect to image quality. Particularly, this approach is of decisive importance for lithographic printing plates since the behavior in the development of the image, both in exposure and development and the printing process, such as, for example, ink acceptance, scratch resistance and press life, is critically influenced by the polymeric binders.

SUMMARY OF THE INVENTION

Increased plate performance is achieved with negative-working thermally activatable compositions comprising a light absorbing component or light to heat converter material, an acid releasing agent, a cross-linking agent and a particular class of acetal polymer as a resin binder component. The acetal polymers are described for use in positive-acting plates in U.S. Pat. Nos. 6,255,033 and 6,541,181 (Levanon et al. patents), which Levanon et al. patents are herein incorporated by reference.

DETAILED DESCRIPTION OF INVENTION

This invention relates to binders and compositions which are suitable for the production of lithographic printing plates, in particular for negative-working coating compositions that are capable of being used either as thermal computer to plate (CtP) or as both conventional light source and computer to plate (CtP) compositions. Advantageously, the composition can contain materials that permit the use of either conventional light sources or laser light sources for the same plate. This enables the user to expose printing plates using existing analogue plate-making equipment in case of failure of the CtP device.

The negative-working thermally activatable compositions comprise a light absorbing component or light to heat converter material, an acid releasing agent, a cross-linking agent and a particular class of acetal polymer as a resin binder component. Preferred imaging elements of the invention are heat-sensitive compositions based on these polymers that after the imaging process with near-infrared wavelength applied by a laser imaging device undergo a further thermal cross-linking reaction through heating, which reduces their solubility in alkaline solutions.

Therefore, according to a first embodiment, this invention comprises acetal polymers bearing the following recurring units within the polymer backbone:

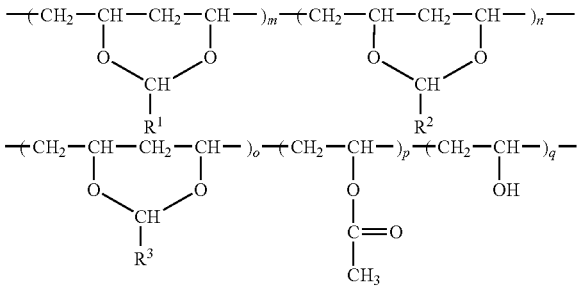

The advantage is that they require lower temperatures during the pre-heat process and possess better resistance to solvent than the polymers described in the prior art.

One component of the practice to the present invention is the selection of the thermally sensitive polymer component for the negative-acting resist layer. The acetal polymer, as generally described above, should comprise from at least about 5 to at most about 60% mole percent of phenolic groups (or number percent of units within the polymer chain):

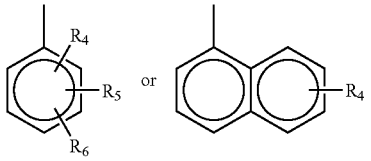

wherein $R_4$=—OH; $R_5$=—OH or —$OCH_3$ or —Br or —O—$CH_2$—C≡CH; and $R_6$=—Br or —$NO_2$;

$R_3$=—$(CH_2)_a$—COOH, —C≡CH, or

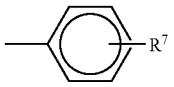

where $R_7$=COOH, —$(CH_2)_a$—COOH, —O—$(CH_2)_a$—COOH, and a=0 or 1, and m=5-40 mole %, preferably 15 to 35 mole % g=10-60 mole %, preferably 20 to 40 mole % o=0-20 mole %, preferably 0 to 10 mole % p=2-20 mole %, preferably 1 to 10 mole % q=5-50 mole %, preferably 15 to 40 mole %

The variation in the proportion of these groups enables one of ordinary skill in the art to tailor the properties of the polymer to any specific needs in the resist process of resist element used in the practice of the present invention. The use of lower percentage portions of the required phenolic substituent (e.g., 5-40%, 10-30%, 15-30%) provides for a more flexible, less brittle polymer, while the use of higher percentages (e.g., 30-60%, 35-50%) provides for a polymer that is made more readily soluble in the developer. It is within the scope of the present invention to provide other linking groups within the polymer chain to tailor the polymer further.

Where the terminology "the polymer chain comprising" is used or no legally limiting language is used, that language allows for the presence of other groups within the polymer chain. Where the language "the polymer chain consisting essentially of" or "the polymer chain consisting of" is used, that language refers to limiting only the general types of repeating units on the polymer chain and does not apply to limiting the substitution on the polymer chain units themselves.

As indicated by the above structural formula, the acetal polymers of this invention can be the required tetrameric acetal polymers, or alternatively to obtain further modifications of the properties of the acetal polymers with pentameric or higher order polymers. In the tetrameric polymer, the recurring unit comprises a vinyl acetate moiety and a vinyl alcohol moiety and first and second cyclic acetal groups as defined above. In the pentamers, the recurring unit comprises a vinyl alcohol moiety, a vinyl acetate moiety and first, second and third cyclic acetal group as described above. Higher mers contain a further type of cyclic acetal moiety or an alternative ester functionality.

All three of the described available acetal groups are six-member cyclic acetal groups, one of them is substituted with an alkyl group, another with an aromatic group substituted with a hydroxy-, or a hydroxy- and alkoxy-, or hydroxy- and optionally nitro-, Br— group and acetylene —C═C— groups; and a third is substituted with an acid group, an acid substituted alkyl group or an acid substituted aryl group.

The present technology includes blends of polyvinyl acetal resins derived from aliphatic and aromatic aldehydes containing hydroxyl and/or other functional groups, described above, with other polymers such as acrylates, methacrylates, polyurethanes, styrene-maleic anhydride copolymers, phenolics, polyvinyl ketones, alkylvinylethers, cellulose derivatives, epoxy resins and others. These other resins may also provide additional physical properties that may be desirable for particular applications of the resist coatings of the present invention. For example, more oleophilic resins or polymers may be used to enhance the inking properties of a lithographic element.

The polyvinyl acetal polymers of this invention comprise acetal polymers bearing the following recurring units within the polymer backbone:

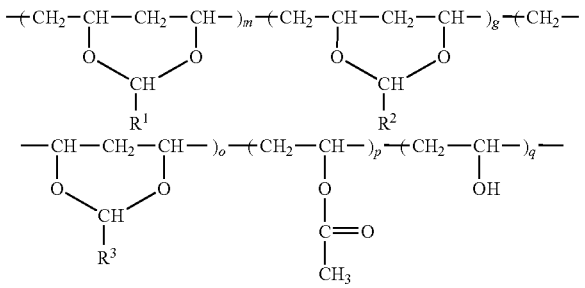

wherein:

$R_1$ is $—C_nH_{2n+1}$ where n=1-12;

$R_2$ is

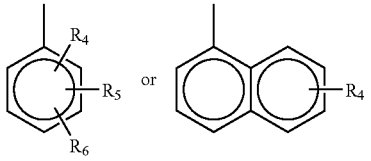

wherein $R_4$=—OH; $R_5$=—OH or —$OCH_3$ or —Br or —O—$CH_2$—C═CH; and $R_6$=Br or —$NO_2$;

$R_3$=—$(CH_2)_a$—COOH or —C═CH or

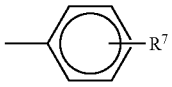

where $R_7$=COOH, —$(CH_2)_a$COOH or —O—$(CH_2)_a$COOH, and a=0 or 1, and m=about 5-40 mol %, preferably 15 to 35 mole % g=about 10-60 mole %, preferably 20 to 40 mole % o=0-20 mole %, preferably 0 to 10 mole % p=1-20 mole %, preferably 1 to 10 mole % q=5-50 mole %, preferably 15 to 40 mole %

As indicated by the above structural formula, the acetal polymers of this invention can be tetramers, in which the recurring unit comprises a vinyl acetate moiety and a vinyl alcohol moiety and first and second cyclic acetal groups, or pentamers in which the recurring unit comprises a vinyl alcohol moiety, a vinyl acetate moiety and either first, second and third cyclic acetal group or two cyclic acetal moieties and an ester moiety. All of the acetal groups are six-member cyclic acetal groups, one of them is substituted with an alkyl group, another with an aromatic group substituted with a hydroxyl-, or a hydroxyl- and alkoxyl-, or hydroxyl-, and nitro- and bromine-groups, or carboxyl groups; and the third or third and fourth cyclic acetal group is substituted with a carboxylic acid group, a carboxylic acid substituted alkyl group or a carboxylic acid substituted aryl group or with alkyl aryl, alkenyl aryl or alkenyl functional groups.

The polymer structure was chosen because the mechanical properties of polymers based on a polyvinyl alcohol backbone are known as superior, the film forming characteristics are excellent, abrasion resistance is very good, also the resistance to chemical attack is excellent. The possibilities of modifying the polyvinyl alcohol are broad and easy performable.

The pendant acetal moieties are responsible for the thermal characteristics ($T_g$), hydrophobicity and ink acceptivity, when used for printing plate production. The proportion of remaining alcohol and the position and amount of phenolic or carboxyl functionality determine the developability and reactivity with the cross-linking resin. These proportions may vary across the entire range of available percentages and still achieve at least some of the benefits of the practice of the new technology described herein. It is important to note that the benefits of the use of an additive previously known to be specific to the use of a positive-acting plate and formulation (as in the Levanon et al. patents) are neither the same benefits nor expected benefits from the teachings of the Levanon et al. patents. In fact, their use in a system operating in a fundamentally opposite manner from the compositions in which they have been disclosed by Levanon is highly indicative of both an unexpected environment for use and of unexpected benefits.

The polyvinyl acetal polymers that are used as the binder resin alone or in combination with other polymers in heat-sensitive compositions according to the present invention can be prepared from inexpensive readily available polymers. Starting substances for the preparation of the polymers according to the invention, are vinyl acetate-vinyl alcohol copolymers containing at least about 80% vinyl alcohol units and having mean molecular weights of about 2000 to 120000 or higher, preferably about 8000 to 50000 (the molecular weights being either number average or weight average molecular weights Examples of suitable polyvinyl alcohols include those available in a range of molecular weights from Clariant™ GMbH under the trademark MOWIOL™ polymer other suitable polyvinyl alcohols available from AIR PRODUCTS CORP. under the trademark AIRVOL® polymers 103, 203, 502, etc.

Examples of suitable aldehydes useful in preparing the acetal polymers of this invention include:

Acetaldehyde; n-butyraldehyde; n-caproaldehyde; n-heptaldehyde; isobutyraldehyde; isovaleraldehyde; hydroxybenzaldehyde; bicyclo[2,2,1]hept-5-ene 2 carboxaldehyde; 2-hydroxy-1-naphthaldehyde; 2,4-dihydroxybenzaldehyde; 3,5-dibromo -4-hydroxybezaldehyde; 4-oxypropynyl-3-hydroxybenzaldehyde; salicylaldehyde; methacrolein; vanillin; isovanillin; cinnamaldehyde; glyoxylic acid; 2-formylphenoxyacetic acid; 3-methoxy-4-formylphenoxy acetic acid; propargyl aldehyde; their mixtures and the like.

Acetalization of the polyvinyl alcohols takes place according to known standard methods; examples are described in U.S. Pat. No. 4,665,124; U.S. Pat. No. 4,940,646; U.S. Pat. No. 5,169,898; U.S. Pat. No. 5,700,619; U.S. Pat. No. 5,792,823; JP 09,328,519 etc.

The radiation absorbing materials suitable for the invented heat-sensitive compositions can be chosen from a wide range of organic and inorganic pigments such as carbon blacks, phthalocyanines or metal oxides. Green pigments: Heliogen Green D8730, D 9360, and Fanal Green D 8330 produced by BASF; Predisol™ 64H-CAB678 produced by Sun Chemicals, and black pigments: Predisol™ CAB2604, Predisol™ N1203, Predisol™ Black CB-C9558 produced by Sun Chemicals Corp. may serve examples for effective heat absorbing pigments. The amount of these pigments used in the composition is from 2 to 20% by weight of the composition, or preferred 2 to 7% by weight of the composition. Infrared absorbing dyes are the preferred heat absorbing agents, which may be used in the composition of the invention, especially those absorbing at wavelengths longer than 700 nm, such as between about 700 and 1100 nm.

Preferably the IR absorbing dye is a squarylium dye for example, 1,3-bis[(2,6-di-t-butyl-4H-thiopyran-4-ylidene) methyl]-2,4-dihydroxy-dihydroxide-cyclobutene diylium-bis {inner salt the dye having a squarylium ring the 1- and 3-positions of which are each connected, via a single $sp^2$ carbon atom, to a pyrylium, thiopyrylium, benzpyrylium or benzthiopyrylium moiety, at least one of the $sp^2$ carbon atoms having a hydrogen atom attached thereto, and the 2-position of the squarylium ring bearing an $O^-$, amino or substituted amino, or sulfonamido group or the dihydroperimidine substituted squarylium salts such as those described in U.S. Pat. No. RE38,251. Preferably, the proportion of the IR dye is 0.01 to 1.0 parts by weight (referred to as "part" hereinafter) relative to one part of acid progenitor, and preferably, the amount of the binder is 2 to 100 parts, and more preferably, 5 to 50 parts, relative to one part of the acid progenitor.

Conventional photochemical acid progenitors (hereinafter known as acid progenitors) well known in the art can be used in the present invention. Non-limiting examples include s-triazine compounds substituted with at least one trihalomethyl group such as 2,4,6-tris(trichloromethyl)-s-triazine, 2-(4-methoxyphenyl)-4,6-bis-(trichloromethyl)-s-triazine, 2-(4-methoxy-1-naphthalenyl)-4,6-bis(trichloromethyl)-s-triazine and the like, iron-arene complexes such as ((eta)$\eta^6$-isopropylbenzene)($\eta^5$-cyclopentadienyl)iron (II) hexafluorophosphate, ($\eta^6$-xylenes)($\eta^5$-cyclopentadienyl) iron (II) hexafluoroantimonate and the like, and onium salts such as diaryliodonium salts, triarylsulfonium salts, triarylselenonium salts, dialkylphenacylsulfonium salts, dialkyl-4-hydroxyphenylsulfonium salts, aryldiazonium salts, nitrobenzyl esters such as p-toluenesulfonic acid ester of p-nitrobenzyl alcohol and the like, sulfonic acid esters such as α-hydroxymethylbenzoinsulfonic acid ester and the like.

Compounds which may be used as crosslinking agents include amino compounds having as functional groups at least two alkoxymethyl groups, methylol groups, or acetoxymethyl groups and the like. Examples include melamine derivatives (e.g., hexamethoxymethylated melamine, available from Mitsui-Cyanamid, Ltd. as CYMEL® 300 series (1) and the like); benzoguanamine derivatives (e.g., methyl/ethyl mixed alkylated benzoguanamine resin, available from Mitsui-Cyanamid, Ltd. as CYMEL® 1100 series (2)) and the like); and glycoluril derivatives (e.g., tetramethylolglycoluril, available from Mitsui-Cyanamid, Ltd. as CYMEL® 1100 series (3) and the like). Also included are di-substituted aromatic compounds having functional groups such as alkoxymethyl groups, methylol groups, acetoxymethyl groups and the like. Examples of such compounds include 1,3,5-trihydroxymethylbenzene, 1,3,5-triacetoxymethylbenezene, 1,2,4,5-tetraacetoxymethylbenzene, and the like. These crosslinking agents can be synthesized according to the method described in Polym. Mater. Sci. Eng., 64, 241 (1991).

The amount of the crosslinking agent is preferably 0.1 to 100 parts, more preferably 0.2 to 50 parts, relative to one part of the photochemical acid generator.

Suitable colorants for increasing the image contrast are those which are readily soluble in the solvent or solvent mixture used for coating or which can be introduced in disperse form as a pigment. The suitable contrast colorants include Rhodamine dyes, triarylmethane dyes such as methyl violet, malachite green etc., anthraquinone pigments and phthalocyanine dyes and pigments. The colorants are contained in the photosensitive composition in an amount of from 0.1 to 15% by weight, preferably from 0.2 to 7% by weight.

The composition according to the invention may furthermore contain a plasticizer. Preferred plasticizers include sorbitan monooleates and the like, dibutyl phthalate, triaryl phosphate and dioctyl phthalate. The amounts of plasticizer used are preferably from 0.25 to 5% by weight in the photosensitive composition. Further, the composition of the present invention may contain other various additives, such as a coating property-improving agent, a development-improving agent, an adhesion-improving agent, a sensitivity-improving agent and an oleophilic agent in a range not to impair the desired properties.

The solvent is not particularly limited so long as it presents adequate solubility to the components used and provides an excellent coating property. For example, it may be a cellosolve solvent such as methylcellosolve, ethylcellosolve, methylcellosolve acetate or ethylcellosolve acetate, a propylene glycol solvent such as propylene glycol monomethyl ether, propylene glycol monoethyl ether, propylene glycol monobutyl ether, propylene glycol monomethyl ether acetate, propylene glycol monoethyl ether acetate, propylene glycol monobutyl ether acetate or dipropylene glycol dimethyl ether, an ester solvent such as butyl acetate, amyl acetate, ethyl lactate, butyl lactate, diethyl oxalate, ethyl pyruvate, ethyl-2-hydroxy butyrate, ethyl acetoacetate, methyl lactate, ethyl lactate or methyl 2-methoxypropionate, an alcohol solvent such as heptanol, hexanol, diacetone alcohol or furfuryl alcohol, a ketone solvent such as methyl ethyl ketone, cyclohexanone or methyl amyl ketone, a highly polar solvent such as dimethylformamide, dimethylacetamide or N-methylpyrrolidone or a solvent mixture thereof, or a mixture thereof with an aromatic hydrocarbon. The proportion of the solvent is usually within a range of from 1 to 200 times by weight, to the total amount of the photosensitive composition. A composition of the present invention is prepared, for example, by mixing the binder of the formula, an infra-red absorbing dye, an acid progenitor and a crosslinking agent or the like. This composition may be coated by any method known in the art (e.g., knife coating, bar coating, curtain coating, etc.) on a substrate. The nature of the substrate is not critical and includes, for example, paper, plastic, metal plates, etc. Various coating aids and solvents may also be present, e.g., Propylene glycol monomethyl ether, For example, a photosensitive material having high sensitivity to near infrared radiation can be prepared by coating a solution of the composition of the present invention dissolved in a solvent (such as methylethylketone and the like) on an aluminum plate and drying. For the production of aluminum lithographic printing plates, the aluminum is first roughened by brushing in the dry state, by brushing with suspensions of abrasives or by an electrochemical method, for example in a hydrochloric acid electrolyte. The plates which have been roughened and, optionally, anodically oxidized in sulfuric or phosphoric acid are then subjected to a hydrophilizing after treatment, preferably in aqueous solutions of polyvinylphosphonic acid, sodium silicate or phosphoric acid. The details of the above-mentioned substrate pretreatment are sufficiently well known to a person skilled in the art.

The dry layer weights of the coating is in the range from 0.4 to 3 g/m$^2$, particularly preferably from 0.6 to 2.5 g/m$^2$.

In the practice of the present invention, light sources from the U.V. to near infrared are used to deliver an electromagnetic radiation pattern which can be absorbed either by the Infra-red absorbing dye of formula (I) or directly by the acid-progenitor or other absorbing dye materials within imaging layers. The choice of absorbing dye is dependant on the nature of the radiation source used. Suitable light sources include mercury lamps, carbon arc lamps, xenon lamps, metal halide lamps, tungsten lamps, halogen lamps, flash lamps, light-emitting diodes, laser rays, semiconductor diode lasers, Ti-Sapphire lasers and the like.

It is advantageous to employ light sources which are relatively richer in near infrared wavelengths. Preferred non-laser light sources include high power (250 W to 10 kW) tungsten lamps and xenon lamps. When a laser is used it is preferred that it emit in the red or near infrared region of the electromagnetic spectrum, especially from about 700 to 1200 nm. Suitable laser sources in this region include Nd:YAG, Nd:YLF and semi-conductor lasers. The preferred lasers for use in this invention include high power single mode laser diodes, fiber-coupled laser diode arrays, and laser diode bars producing light in the near infrared region of the electromagnetic spectrum.

The entire construction may be exposed at once, or by scanning, or with a pulsed source, or at successive times in arbitrary areas. Simultaneous multiple exposure devices may be used, including those in which the light energy is distributed using optical fibers, deformable micromirror arrays, light valves, and the like. Preferably, a solid state infrared laser or laser diode array is used. Sources of relatively low intensity are also useful, provided they are focused onto a relatively small area. If a non-laser light source is used, the entire construction may be exposed at once through an image mask, such as a graphic arts film mask or a chrome glass mask.

Exposure may be directed at the surface of the imaging layer containing the imaging materials of this invention, or through a transparent substrate beneath such an imaging layer. Exposure energies will depend on the type of sensitizer of compound (I), the type of photochemical acid generator, and the type of materials used in creating the image. The rate of scanning during the exposure may also play a role. Exposure energies will be chosen so as to provide a degree of cure or reaction to be useful for the particular application. Laser exposure dwell times are preferably about 0.05 to 50 microseconds and laser fluences are preferably about 0.001 to 1 J/cm$^2$. Non-laser exposure dwell times are preferably about 1 second to about 3 minutes and fluences are preferably about 0.01 to 0.6 J/cm$^2$.

Following exposure, the coating is subjected to heating using either a conventional oven or an oven through which materials are carried on a conveyor system, such as one made by Glunz & Jensen, (Denmark). The temperature used can be between 100° C. and 170° C. for times of between 10 seconds and 150 seconds. More preferably the temperature is between 110° C. and 150° C. for between 15 seconds and 60 seconds. Clearly in practice, there is a preference for shorter dwell times so as to increase productivity of the plate making system. The limitation is provided by obtaining the sufficient level of crosslinking to obtain a robust image.

Following the pre-heat process the coating is developed. As the developer, an alkali developer is preferred. As the alkali developer, an aqueous solution of an alkali metal salt such as sodium hydroxide, potassium hydroxide, sodium carbonate, potassium carbonate, sodium metasilicate, potassium metasilicate, sodium secondary phosphate or sodium tertiary phosphate, may, for example, be mentioned. The concentration of the alkali metal salt is preferably from 0.1 to 20 wt %. Further, an anionic surfactant, an amphoteric surfactant or an organic solvent such as an alcohol, may be added to the developer, as the case requires. An example of such a developer is Southern Lithoplate 830N thermal developer.

Following development, the resulting printing plate is rinsed with water and dried. Drying may be conveniently carried out by infrared radiators or with hot air. After drying, the printing plate may be treated with a gumming solution comprising one or more water-soluble polymers, for example polyvinylalcohol, polymethacrylic acid, polymethacrylamide, polyhydroxyethylmethacrylate, polyvinylmethylether, gelatin, and polysaccharide such as dextrin, pullulan, cellulose, gum arabic, and alginic acid. A preferred material is gum arabic.

The invention is explained in more detail below with reference to embodiments, but without being restricted thereby.

COMPARATIVE EXAMPLE 1

A solution in Dowanol® solvent PM (Dow Chemical Wilmington, Del.) and MEK consisting of 2 g of Novolak LB744 (Borden Packaging & Industrial Products, Louisville, Ky.), 0.02 g of CYMEL™ 303 (American Cyanamid Co., Wayne, N.J.), 0.02 g TTT, (2,4,6-tris(trichloromethyl)-1,3,5-triazine PCAS, France), 0.0072 g malachite green (Aldrich Chemicals, Milwaukee, Wis.) and 0.003 g of 2,2-bis(hydroxymethyl)-2,3-dihydro -1H-perimidine based squarylium dye made according to U.S. Pat. No. RE 38,251 1d was coated with a No. 6 coating rod (R&D Specialties, Webster, N.Y.) onto 200 micron-thick grained and anodized aluminum printing plate base and dried in an oven at 90° C. for 3 minutes.

EXAMPLE 2

A solution in Dowanol™ solvent PM (Dow Chemical Wilmington, Del.) and MEK consisting of 2 g of the acetal resin 1 0.02 g of CYMEL™ 303 (American Cyanamid Co., Wayne, N.J.), 0.02 g TTT, (2,4,6-tris(trichloromethyl)-1,3,5-triazine PCAS, France), 0.0072 g malachite green (Aldrich Chemicals, Milwaukee, Wis.) and 0.003 g of 2,2-bis(hydroxymethyl) -2,3-dihydro-1H-perimidine based squarylium dye made according to U.S. Pat. No. RE38,251 1d was coated with a No. 6 coating rod (R&D Specialties, Webster, N.Y.) onto 200 micron-thick grained and anodized aluminum printing plate base and dried in an oven at 90° C. for 3 minutes.

EXAMPLE 3

A solution in Dowanol™ solvent PM (Dow Chemical Wilmington, Del.) and MEK consisting of 2 g of the acetal resin 2 0.02 g of CYMEL™ 303 (American Cyanamid Co., Wayne, N.J.), 0.02 g TTT, (2,4,6-tris(trichloromethyl)-1,3,5-triazine PCAS, France), 0.0072 g malachite green (Aldrich Chemicals, Milwaukee, Wis.) and 0.003 g of 2,2-bis(hydroxymethyl)-2,3-dihydro-1H-perimidine based squarylium dye made according to U.S. Pat. No. RE 38,251 1d was coated with a No. 6 coating rod (R&D Specialties, Webster, N.Y.) onto 200 micron-thick grained and anodized aluminum printing plate base and dried in an oven at 90° C. for 3 minutes.

The plates thus prepared of comparative example 1, example 2 and example 3 were imaged on a Newsetter® 70 made by Creo, Inc. using 15 W. Plates were subsequently pre-heated at a range of temperatures and developed in 830N developer (Southern Lithoplate Inc., Youngsville, N.C.) for 30s, the exposed areas remained and the unexposed areas were washed off to leave a negative image. The resistance to solvent was determined by recording the number of deletion pen (Southern Lithoplate Inc.) swipes to remove the image.

| Example No. | Swipes at 275° F. Pre-heat Temp | Swipes at 265° F. Pre-heat Temp | Swipes at 255° F. Pre-heat Temp | Swipes at 245° F. Pre-heat Temp | Swipes at 235° F. Pre-heat Temp |
|---|---|---|---|---|---|
| Comparative example 1 | 20 | 6 | Image removed in developer | Image removed in developer | Image removed in developer |
| Example 2 | 35 | 30 | 25 | 22 | 18 |
| Example 3 | 40 | 37 | 32 | 26 | 22 |

EXAMPLE 4

A solution in Dowanol™ solvent PM (Dow Chemical Wilmington, Del.) and MEK consisting of 2 g of the acetal resin 1 0.02 g of CYMEL 303 (American Cyanamid Co., Wayne, N.J.), 0.02 g TTT, (2,4,6-tris(trichloromethyl)-1,3,5-triazine PCAS, France), 0.0072 g crystal violet (Aldrich Chemicals, Milwaukee, Wis.). 0.003 g of 2,2-bis(hydroxymethyl)-2,3-dihydro-1H-perimidine based squarylium dye made according to U.S. Pat. No. RE 38,251 1d and 0.001 g surfactant FC430 (Minnesota Mining and Manufacturing Co), was coated with a No. 6 coating rod (R&D Specialties, Webster, N.Y.) onto 200 micron-thick grained and anodized aluminum printing plate base and dried in an oven at 90° C. for 3 minutes. The plates of comparative example 1, example 2 and example 3 were imaged on a Newsetter™ 70 made by Creo, Inc. using 15 W. Plates were subsequently pre-heated at a range of temperatures and developed in 830N developer Southern Lithoplate, Youngsville, N.C.) for 30 seconds (s), the exposed areas remained and the unexposed areas were washed off to leave a negative image. The resistance to solvent was determined by recording the number of deletion pen swipes to remove the image. The resistance of the plate coating at a 255° F. pre-heat temperature was 20.

EXAMPLE 5

A solution in Dowanol™ solvent PM (Dow Chemical Wilmington, Del.) and MEK consisting of 2 g of the acetal resin 1 0.02 g of CYMEL™ 303 (American Cyanamid Co., Wayne, N.J.), 0.02 g ditolyliodonium hexafluorophosphate, 0.0072 g crystal violet (Aldrich Chemicals, Milwaukee, Wis.) and 0.003 g of 2,2-bis(hydroxymethyl)-2,3-dihydro -1H-perimidine based squarylium dye made according to U.S. Pat. No. RE38,251 1d was coated with a No. 6 coating rod (R&D Specialties, Webster, N.Y.) onto 200 micron-thick grained and anodized aluminum printing plate base and dried in an oven at 90° C. for 3 minutes. The plates of comparative example 1, example 2 and example 3 were imaged on a Newsetter 70 made by Creo Inc using 15 W. Plates were subsequently pre-heated at a range of temperatures and developed in 830N developer Southern Lithoplate, Youngsville, N.C.) for 30s, the exposed areas remained and the unexposed areas were washed off to leave a negative image. The resistance to solvent was determined by recording the number of deletion pen swipes to remove the image. The resistance of the plate coating at a 255° F. pre-heat temperature was 15.

EXAMPLE 6

A solution in Dowanol™ solvent PM (Dow Chemical Wilmington, Del.) and MEK consisting of 2 g of the acetal resin 1 0.02 g of CYMEL 300 (American Cyanamid Co., Wayne, N.J.), 0.02 g ditolyliodonium hexafluorophosphate, 0.0072 g crystal violet (Aldrich Chemicals, Milwaukee, Wis.) and 0.003 g of 2,2-bis(hydroxymethyl)-2,3-dihydro -1H-perimidine based squarylium dye made according to U.S. Pat. No. RE38,251 1d was coated with a No. 6 coating rod (R&D Specialties, Webster, N.Y.) onto 200 micron-thick grained and anodized aluminum printing plate base and dried in an oven at 90° C. for 3 minutes. The plates of comparative example 1, example 2 and example 3 were imaged on a Newsetter™ 70 made by Creo Inc using 15 W. Plates were subsequently pre-heated at a range of temperatures and developed in 830N developer Southern Lithoplate, Youngsville, N.C.) for 30s, the exposed areas remained and the unexposed areas were washed off to leave a negative image. The resistance to solvent was determined by recording the number of deletion pen swipes to remove the image. The resistance of the plate coating at a 255° F. pre-heat temperature was 17.

The results from the comparative example and the examples according to the invention show that printing plates coating compositions with the acetal binders have better solvent resistance characteristics and can be used with lower pre-heat temperatures that reduce costs to the user.

The technology described herein may be generally described as a negative-acting photolithographic printing plate precursor and a method for using that printing plate precursor. In general terms, the printing plate precursor is a substrate having a surface; coated with a unique negative-acting photosensitive composition. The photosensitive composition comprises an acetal polymer, an infrared absorbing dye or pigment, a crosslinking agent for the acetal resin and a photosensitive chemical acid progenitor, and the acetal polymer has within its backbone a structure comprising a moiety of the formula:

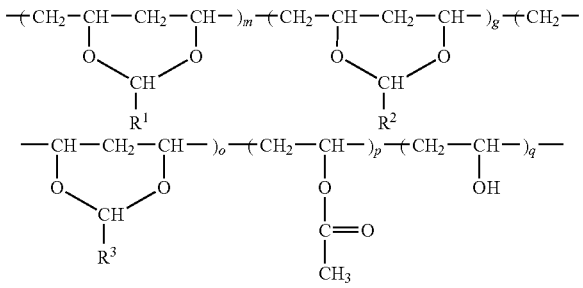

wherein:

$R_1$ is $—C_nH_{2N+1}$ where n=1-12;

$R_2$ is

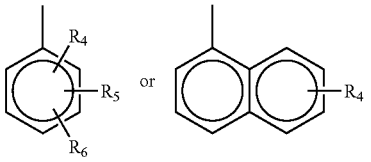

wherein $R_4$=—OH; $R_5$=—OH or $—OCH_3$ or —Br or $—O—CH_2—C═CH$; and $R_6$=Br or $—NO_2$;

$R_3$=$—(CH_2)_a—COOH$ or —C═CH or

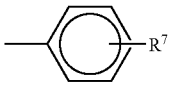

where $R_7$=COOH, $—(CH_2)_aCOOH$ or $—O—(CH_2)_aCOOH$, and a=0 or 1, and m=about 5-40 mol %, g=about 10-60 mole %, o=0-20 mole %, p=1-20 mole %, and q=5-50 mole %, preferably 15 to 40 mole %.

Preferred ranges of materials for use in the plate precursor may have preferred ranges of materials and components such as wherein m=15 to 35 mole %; g=20 to 40 mole %; o=0 to 10 mole %; p=preferably 1 to 10 mole %; q=15 to 40 mole %; wherein R2 comprises a phenyl group having 1, 2 or 3 substituents independently selected from the group consisting of a first substituents selected from the group consisting of:

a) —OH;

b) a second substituent selected from the group consisting of: OH; $—OCH_3$; —Br; and $—O—CH_2—C═CH$; and c) a third substituent selected from the group consisting of $═(CH_2)_a—COOH$ or —C═CH or

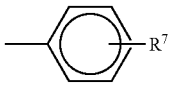

where $R_7$=COOH, $—(CH_2)_aCOOH$ or $—O—(CH_2)_aCOOH$, and a=0 or 1,

The preferred crosslinking agents comprise amino compounds having as functional groups at least two groups selected from the group consisting of alkoxymethyl groups, methylol groups, and acetoxymethyl groups.

A method of forming a printing plate from the printing plate precursors described herein would include exposing the photosensitive composition to an imagewise distribution of infrared radiation that is absorbed by the dye or pigment in a sufficient amount to cause photoinitiated polymerization of the photosensitive composition. Then a developer solution is applied to the surface to remove at least some photosensitive composition from areas that have not undergone photoinitiated polymerization. A preferred step for improving the quality of the printing surface of the exposed and incompletely developed plate is to heat the printing plate precursor at a temperature above 200F. and below 270F. after exposure but before applying the developer.

Although specific species of materials, specific temperatures and specific times are used in the examples and certain portions of the disclosure, unless otherwise stated, these disclosures are intended to support the generic concepts recited in the claims and are not intended to limit the generic interpretation of the claims and limitations recited therein.

What is claimed:

1. A negative-acting photolithographic printing plate precursor comprising:

a substrate having a surface; and a negative-acting photosensitive composition on the surface, wherein the photosensitive composition comprises an acetal polymer, an infrared absorbing dye or pigment, a crosslinking agent comprising amino compounds having at least two functional groups for the acetal resin and a photosensitive chemical acid progenitor, and the acetal polymer has within its backbone a structure comprising a moiety of the formula:

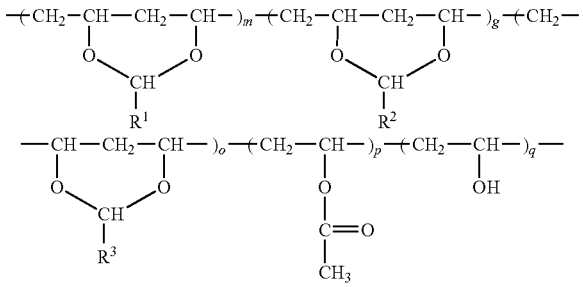

wherein:

$R_1$ is $—C_nH_{2N+1}$ where n=1-12;

$R_2$ is

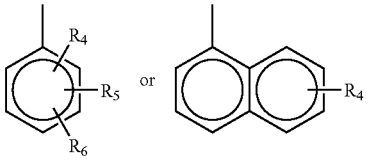

wherein $R_4$=—OH; $R_5$=—OH or —$OCH_3$ or —Br or —O—$CH_2$—C═CH; and $R_6$=Br or —$NO_2$;

$R_3$=—$(CH_2)_a$—COOH or —C═CH or

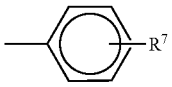

where $R_7$=COOH, —$(CH_2)_a$COOH or —O—$(CH_2)_a$COOH, and a =0 or 1, and m=about 5-40 mol %, g=about 10-60 mole %, o=0-20 mole %, p=1-20 mole %, and q=5-50 mole %, preferably 15 to 40 mole %.

2. The plate precursor of claim 1 wherein m=15 to 35 mole %; g=20 to 40 mole %; o=0 to 10 mole %; p=preferably 1 to 10 mole %; q=15 to 40 mole %.

3. The plate precursor of claim 1 wherein R2 comprises a phenyl group having 1, 2 or 3 substituents independently selected from the group consisting of a first substituents selected from the group consisting of:

a) —OH;

a second substituent selected from the group consisting of:

b) OH; —$OCH_3$; —Br; and —O—$CH_2$—C═CH; and a third substituent selected from the group consisting of

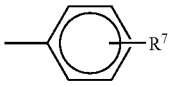

c)=—$(CH_2)_a$—COOH or —C═CH or where $R_7$=COOH, —$(CH_2)_a$COOH or —O—$(CH_2)_a$COOH, and a=0 or 1.

4. The plate precursor of claim 1 wherein the crosslinking agents comprises amino compounds having as functional groups at least two groups selected from the group consisting of alkoxymethyl groups, methylol groups, and acetoxymethyl groups.

5. A method of forming a printing plate from the printing plate precursor of claim 1 comprising exposing the photosensitive composition to an imagewise distribution of infrared radiation that is absorbed by the dye or pigment in a sufficient amount to cause photoinitiated polymerization of the photosensitive composition and then applying a developer solution to the surface to remove at least some photosensitive composition from areas that have not undergone photoinitiated polymerization.

6. A method of forming a printing plate from the printing plate precursor of claim 2 comprising exposing the photosensitive composition to an imagewise distribution of infrared radiation that is absorbed by the dye or pigment in a sufficient amount to cause photoinitiated polymerization of the photosensitive composition and then applying a developer solution to the surface to remove at least some photosensitive composition from areas that have not undergone photoinitiated polymerization.

7. A method of forming a printing plate from the printing plate precursor of claim 3 comprising exposing the photosensitive composition to an imagewise distribution of infrared radiation that is absorbed by the dye or pigment in a sufficient amount to cause photoinitiated polymerization of the photosensitive composition and then applying a developer solution to the surface to remove at least some photosensitive composition from areas that have not undergone photoinitiated polymerization.

8. The method of claim 5 wherein the printing plate precursor is heated at a temperature above 200° F. and below 270° F. after exposure but before applying the developer.

9. The method of claim 5 wherein the printing plate precursor is heated at a temperature above 200° F. and below 270° F. after exposure but before applying the developer.

10. The method of claim 6 wherein the printing plate precursor is heated at a temperature above 200° F. and below 270° F. after exposure but before applying the developer.

11. The plate precursor of claim 1 wherein R2 comprises a phenyl group having 1 or 2 substituents independently selected from the group consisting of a first substituents selected from the group consisting of:

a) —OH; and a second substituent selected from the group consisting of:

b) OH; $OCH_3$; —Br; and —O—$CH_2$—C═CH.

12. The plate precursor of claim 3 wherein R2 comprises a phenyl group having 1 or 2 substituents independently selected from the group consisting of a first substituents selected from the group consisting of:

a) —OH; and a second substituent selected from the group consisting of:

b) OH; $OCH_3$; —Br; and —O—$CH_2$—C═CH.

13. The plate precursor of claim 4 wherein R2 comprises a phenyl group having 1 or 2 substituents independently selected from the group consisting of a first substituents selected from the group consisting of:

a) —OH; and a second substituent selected from the group consisting of:

b) OH; $OCH_3$; —Br; and —O—$CH_2$—C═CH.

14. A method of forming a printing plate from the printing plate precursor of claim 11 comprising exposing the photosensitive composition to an imagewise distribution of infrared radiation that is absorbed by the dye or pigment in a sufficient amount to cause photoinitiated polymerization of the photosensitive composition and then applying a developer solution to the surface to remove at least some photosensitive composition from areas that have not undergone photoinitiated polymerization.

15. A method of forming a printing plate from the printing plate precursor of claim 12 comprising exposing the photosensitive composition to an imagewise distribution of infrared radiation that is absorbed by the dye or pigment in a sufficient amount to cause photoinitiated polymerization of the photosensitive composition and then applying a developer solution to the surface to remove at least some photosensitive composition from areas that have not undergone photoinitiated polymerization

16. A method of forming a printing plate from the printing plate precursor of claim 13 comprising exposing the photosensitive composition to an imagewise distribution of infrared radiation that is absorbed by the dye or pigment in a sufficient amount to cause photoinitiated polymerization of the photosensitive composition and then applying a developer solution to the surface to remove at least some photosensitive composition from areas that have not undergone photoinitiated polymerization.

* * * * *